United States Patent [19]

Hirose

[11] 3,954,382

[45] May 4, 1976

[54] COMBUSTION APPARATUS AND METHOD

[76] Inventor: Yasuo Hirose, 4-8-9, Kugahara, Ota, Tokyo, Japan

[22] Filed: Dec. 11, 1974

[21] Appl. No.: 531,477

[30] Foreign Application Priority Data

Apr. 8, 1974 Japan ..... 49-38784

[52] U.S. Cl. ..... 431/9; 431/115; 431/252

[51] Int. Cl.[2] ..... F23M 9/00

[58] Field of Search ..... 431/8, 9, 10, 175, 178, 431/115, 116, 252, 352, 190

[56] References Cited

UNITED STATES PATENTS

| | | | |
|---|---|---|---|
| 1,910,735 | 5/1933 | Zikesch | 431/352 |
| 1,947,741 | 2/1934 | Ryan | 431/352 |
| 3,101,769 | 8/1963 | Zink et al. | 431/175 |
| 3,174,527 | 3/1965 | Reed et al. | 431/175 |
| 3,425,781 | 2/1969 | Bitterlich | 431/178 |
| 3,645,095 | 2/1972 | Melconian | 431/352 |
| 3,876,362 | 4/1975 | Hirose | 431/9 |

*Primary Examiner*—Kenneth W. Sprague
*Attorney, Agent, or Firm*—James C. Wray

[57] ABSTRACT

This invention relates to a combustion apparatus provided with a multiple of burners, a annular burner tile structure which is of rectangular section, combustion air passages along the major walls of the burner tile structure, and a series of air inlet holes or an air inlet slit for the purpose of introducing air into the burner tile structure to control the deflection of fuel stream.

The fuel injected into the burner tile structure at a velocity near to sonic velocity generates Coanda Effect and induces high temperature combustion gas into the burner tile structure from the combustor.

This high temperature combustion gas promotes endothermic gasification of fuel prior to the introduction of combustion air into the fuel stream so that complete and uniform combustion is performed under the existence of less combustion air as compared with the combustion in the conventional combustion apparatus, therefore, flame temperature is reduced and consequently, NOx generating rate is remarkably reduced.

17 Claims, 4 Drawing Figures

COMBUSTION APPARATUS AND METHOD

BACKGROUND OF THE INVENTION

The present invention relates to combustion apparatus.

The inventor of this invention made previously an application for patent for the specific combustion method of reducing NOx generating rate. (U.S. Pat. application No.: 452,344, Application Date: Mar. 18, 1974, now U.S. Patent 3,876,362, issued Apr. 8,1975, Title of Invention: Method of Combustion).

According to the prior invention, NOx generating rate is reduced by half without providing any additional device, but by taking advantage of Coanda Effect, the specific effect of high velocity fuel stream, and by simply modifying the conventional burner tile structure.

The present invention is partly an application of the prior invention of the inventor to a combustion apparatus provided with a cylindrical burner tile structure which is of rectangular section and a multiple of burners in order to produce flat flame.

BRIEF DISCRIPTION OF THE INVENTION

It is an object of the invention to provide a combustion apparatus consisting of a cylindrical burner tile structure which is of rectangular section and a multiple of burners for the purpose of producing flat flame.

Another object of the invention is to provide a combustion apparatus which reduces NOx generating rate and flame temperature as well and performs combustion with less combustion air.

A further object of the invention is to apply Coanda Effect, a specific effect of high velocity fuel stream, to combustion apparatus in order to promote quick and uniform endothermic gasification of fuel prior to mixing fuel and combustion air by inducing high temperature combustion gas from the combustor into the burner tile structure.

Still a further object of the invention is to provide the burner tile structure with a series of air inlet holes or an air inlet slit in order to control the fuel stream and to stabilize Coanda Effect.

Another important object of the invention is to provide combustion air passages and combustion air jets along and on the major walls of the burner tile structure which is of rectangular section in order to introduce combustion air into the combustor in the manner that the combustion air flows holding gasified fuel stream in between so that quick and uniform combustion is performed in the combustor.

Other features and advantages of the invention will be apparent from the following description taken in connection with the accompanying drawings.

DETAILED DESCRIPTION OF THE INVENTION

The inventor of this invention made precedently an application for patent for the specific combustion method of reducing NOx generating rate.

According to the prior invention, NOx generating rate is reduced by half without providing any additional device, but by taking advantage of Coanda Effect, the specific effect of high velocity fuel stream, and by simply modifying the conventional burner tile structure.

The combustion apparatus according to the present invention is partly an application of the prior invention, therefore, the invention may be readily understood by the explanation of the method and a preferred embodiment of the prior invention precedent to the explanation of the present invention.

Figure 1:
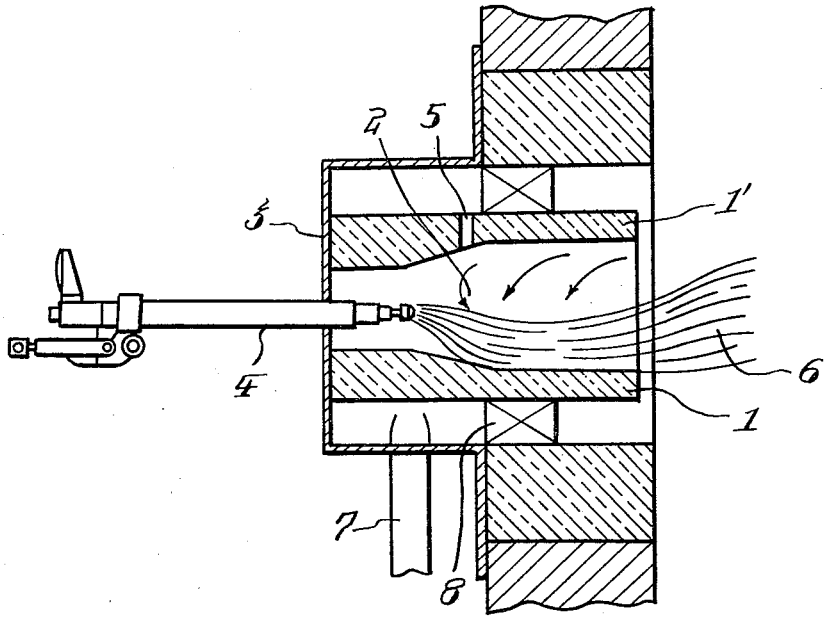
FIG. 1 is a diagrammatic illustration explaining the method of combustion precedently invented and applied for patent by the inventor of the present invention.

Referring to FIG. 1, a cylindrical burner tile structure 2 comprising side walls 1 and 1' is closed at the front end by a cover plate 3 at the center of which a high pressure type gas burner or a high pressure spray type oil burner 4 is secured so as to inject fuel, a mixture of fuel and air or a mixture of fuel and steam at a velocity near to sonic velocity coaxially with the burner tile structure into a combustor 6.

The fuel stream is deflected towards a preferred side wall 1 due to the specific effect of high velocity gas stream, Coanda Effect.

Accordingly, the fuel stream flows into the combustor 6 being interfered with the surface of the burner tile structure.

The direction of the deflection is stabilized by appropriately providing a small air inlet 5 on the wall 1'.

High temperature combustion gas is induced from the combustor 6 into the burner tile structure 2 towards the opposite side of the fuel stream as shown by arrows.

This combustion gas is quickly diffused in the fuel stream promoting quick endothermic gasification of fuel.

The quantity of the high temperature combustion gas induced into the burner tile structure is 50 to 65% of theoretical amount of air.

The fuel burns quickly and uniformly in the combustor when the spinning stream of combustion air is introduced through an air duct 7 and a diffusing vane 8 circumposing the fuel stream at the open end of the burner tile structure.

Thus complete combustion is performed in the combustor with relatively reduced excess air under considerably lower flame temperature of 1200°C as compared with 1350°C in the conventional combustion.

Thus the factors of the prior invention are, Coanda Effect generated by the fuel stream injected into the burner tile structure at a high velocity, constant rate induction of high temperature combustion gas into the burner tile structure from the combustor caused by stabilized Coanda Effect and quick endothermic gasification of fuel effected by the heat of the high temperature combustion gas induced into the burner tile structure and diffused in the fuel stream.

As a combined effect of those factors, fuel burns quickly and uniformly in the combustor when spinning stream of combustion air is introduced circumposing the fuel stream at the open end of the burner tile structure. The flame temperature being considerably lower as compared with the conventional combustion, NOx generating rate is reduced.

As for the present invention, the combustion apparatus is designed so as to produce flat flame in order to attain uniform heat radiation and to reduce NOx generating rate according to the method of the prior invention.

Figure 2:
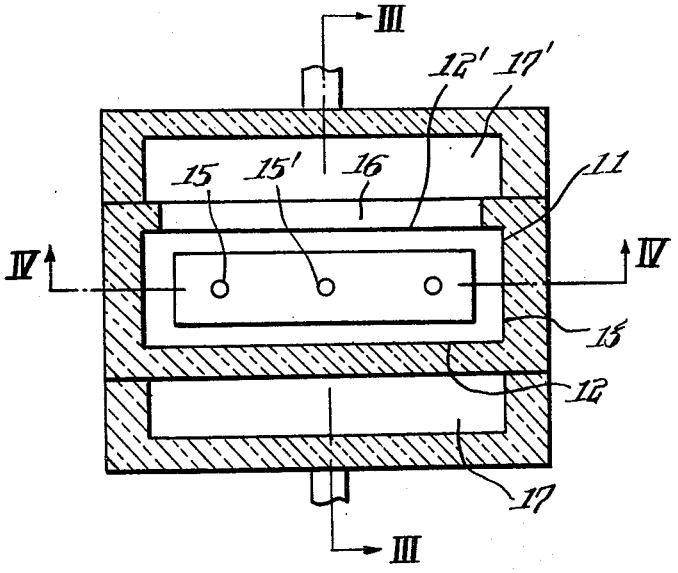
FIG. 2, 3 and 4 are sections of the combustion apparatus according to the present invention taken on lines 11 — 11, 111 — 111 and 1V — 1V respectively.
Figure 3:
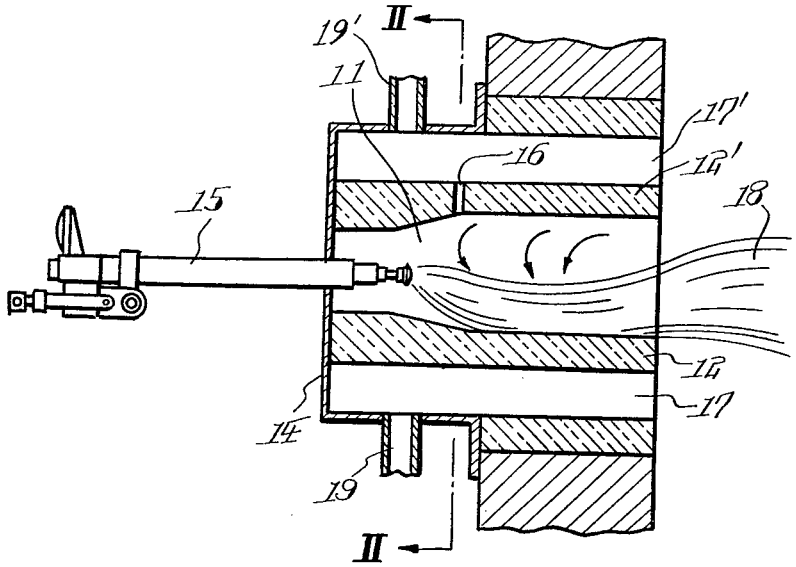
Figure 4:
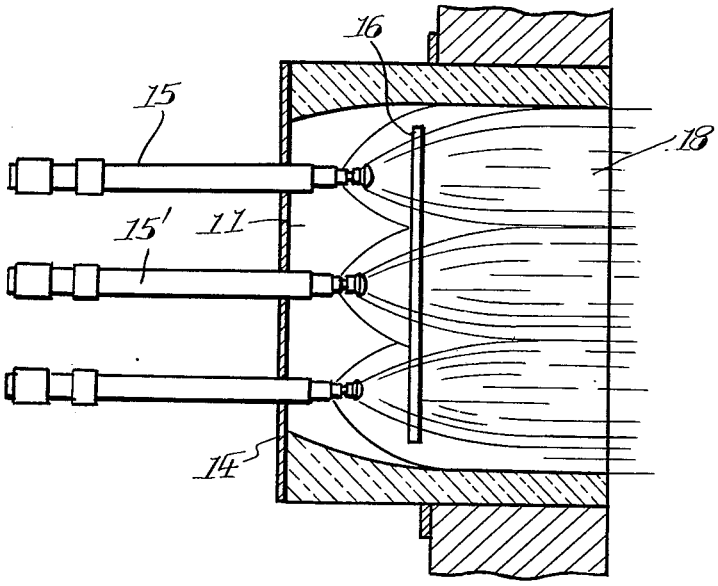

Referring to FIG. 2, 3 and 4, a combustion apparatus according to the present invention comprises; a annular burner tile structure 11 which is of rectangular section consisting of major wall 12 and minor wall 13, one or a multiple of high pressure type gas burners or high pressure spray type oil burners 15, 15', ..... arranged along the central plane of the burner tile structure and secured to a cover plate 14 closing the front end of the burner tile structure, a series of air inlet holes or an air inlet slit 16 on a major wall 12' and combustion air passages and jets 17 and 17' along the outside of the burner tile major walls 12 and 12'.

In operation, high velocity fuel stream injected into the burner tile structure is deflected due to Coanda Effect towards the wall 12 opposite the wall 12' on which air inlet holes or an air inlet slit is provided, as the result of this phenomenon, high temperature combustion gas is induced at a constant rate from a combustor 18 into the burner tile structure 11 along the wall 12' as shown by arrows. This combustion gas is quickly diffused in the fuel stream promoting endothermic gasification of fuel.

Combustion air is supplied through air ducts 19 and 19' and air passages 17 and 17' and introduced into the combustor 18 at the open end of the burner tile structure in the manner that the combustion air flows holding the gasified fuel stream in between so that quick combustion is performed in the combustor 18.

The flat flame produced in the burner tile structure of rectangular section is uniform all over in temperature distribution, so that uniform heat radiation to the vertical direction against the flame plane is attained.

Complete combustion is performed in the combustor with relatively reduced excess air so that flame temperature is lower degree of around 1200°C as compared with that in the conventional combustion, therefore, NOx generating rate is remarkably reduced.

The combustion apparatus according to the present invention is capable of producing flat flame of any breadth by installing a burner tile structure of a preferred rectangular section or any section of similar function and a multiple of burners.

What is claimed as new and desired to be secured by letters patent is:

1. Combustion apparatus which performs combustion reducing NOx generating rate and producing flat flame comprising; a burner tile structure which is of rectangular section, multiple high pressure type burners secured on a cover plate closing the front end of the burner tile structure, means for forming a flat fuel stream along one major wall of the burner tile, the means including a series of air inlet holes or an air inlet slit provided in the opposite major wall of the burner tile structure so as to stabilize the direction of deflection of high velocity fuel stream according to Coanda Effect towards the opposite burner tile wall, combustion air passages and jets along the outside of the burner tile major walls.

2. The method of combustion comprising:

injecting fuel from a nozzle through a cover plate, deflecting the injected fuel toward a long wall, forming a flat fuel screen drawing high temperature combustion gas from a combustion space toward the injected fuel, mixing the combustion gas with the injected fuel, flowing mixed combustion gases and injected fuel toward the combustion space from a space near the long wall, adding oxygen to the fuel and combustion gas mixture, and igniting the mixture in the combustion space.

3. The method of claim 2 wherein the injecting step further comprises injecting the fuel into a space enclosure having spaced opposite first and second major wall portions and spaced opposite first and second minor wall portions interconnecting ends of the major wall portions and wherein the deflecting step comprises deflecting the fuel toward the first major wall portion of the wall enclosure.

4. The method of claim 2 wherein the deflecting step comprises admitting a gas opposite the first major wall portion.

5. The method of claim 2 wherein the injecting step further comprises injecting fuel from a plurality of nozzles arranged parallel to the first major wall portion.

6. The method of claim 2 wherein the drawing step comprises drawing combustion gas into a space near the nozzle opposite the first major wall portion.

7. The method of claim 3 wherein the deflecting step comprises deflecting fuel toward the first major wall portion by a Coanda Effect, wherein the drawing step comprises drawing combustion gas into the space surrounded by the wall enclosure in an area opposite the first major wall portion toward which the fuel is directed, and wherein the flowing step comprises flowing the mixed combustion gas and fuel outward from a space surrounded by the wall enclosure opposite from the nozzle.

8. The method of claim 5 wherein the deflecting step further comprises admitting oxygen through an opening in the second major wall portion into the space laterally surrounded by the wall enclosure in an area remote from the first major wall portion toward which fuel is deflected.

9. The method of claim 5 further comprising admitting oxygen to the combustion space over exterior surfaces of the first and second major wall portions.

10. Fuel combustion apparatus comprising a frame, mounting means connected to the frame for mounting the frame on a fuel burning device having a combustion space, an end plate connected to the frame and having an opening means, fuel injection nozzle means mounted in the opening means in the end plate, a long wall means elongated in a direction parallel to the plate and mounted on the frame and positioned slightly spaced from the opening in the end plate and mounted at an angle to the end plate, fuel deflection means connected to the frame for deflecting fuel from the nozzle means toward the long wall means for forming a flat screen, and combustion gas admission means connected to the frame and positioned between the end plate and the combustion space and mounted opposite the long wall means for admitting combustion gas from the combustion space toward fuel and toward the long wall means, whereby combustion gas and fuel are mixed in a space generally between the wall means and the admission means before flowing into the combustion space.

11. The apparatus of claim 10 further comprising a continuous enclosure wall having first and second spaced opposite major wall portions and first and second spaced opposite minor wall portions interconnecting respective ends of the major wall portions, and being mounted perpendicularly on the end plate and wherein the long wall means comprises a first major wall portion of the enclosure wall, and wherein the admission means comprises an open space along a second major wall portion of the enclosure wall opposite the first major wall portion toward which fuel is deflected.

12. The apparatus of claim 11 further comprising opening means in the second major wall portion for admitting air and deflecting fuel toward the first major wall portion.

13. The apparatus of claim 11 wherein the nozzle means comprise a plurality of nozzles arranged in a plane parallel to the first wall portion.

14. The apparatus of claim 11 further comprising air admission means externally surrounding the first and second major wall portions for flowing air over the enclosure wall and into the combustion space on opposite sides of a mixture of fuel and combustion gases flowing from the enclosure wall into the combustion space.

15. Combustion apparatus for combusting a fuel comprising an annular burner tile for surrounding burner nozzles, the burner tile having first and second opposite major side walls extending a relatively long distance and terminally joining first and second opposite minor walls which extend relatively short distances between the major side walls, the annular burner tile having open ends, and burner nozzle mounting plate means mounted on a first end of the annular burner tile for receiving burners with nozzle openings positioned between the side walls, and means for deflecting fuel to a major side wall for forming a flat full stream whereby issue from the burner nozzles flows along a major wall of the tile through the second open end due to the Coanda Effect.

16. The combustion apparatus of claim 15 further comprising an inlet opening means extending through the second major side wall for admitting air into the burner tile toward the first major side wall, stabilizing flow of issue from the burner nozzles along the second major side wall.

17. The combustion apparatus of claim 15 further comprising air inlet means externally surrounding the first and second major wall portions and opening adjacent the second open end of the annular burner tile for flowing air on first and second sides of issue from the burner nozzles.

* * * * *